US009907406B1

(12) United States Patent
McGrath

(10) Patent No.: US 9,907,406 B1
(45) Date of Patent: Mar. 6, 2018

(54) MATTRESS LIFTING TOOL

(71) Applicant: Terence J McGrath, The Villages, FL (US)

(72) Inventor: Terence J McGrath, The Villages, FL (US)

( * ) Notice: Subject to any disclaimer, the term of this patent is extended or adjusted under 35 U.S.C. 154(b) by 0 days.

(21) Appl. No.: 15/700,487

(22) Filed: Sep. 11, 2017

(51) Int. Cl.
*A47C 21/02* (2006.01)
*A47C 31/00* (2006.01)

(52) U.S. Cl.
CPC ..... *A47C 21/028* (2013.01); *A47C 31/008* (2013.01)

(58) Field of Classification Search
CPC ..... A47C 21/00; A47C 21/028; A47C 21/024
See application file for complete search history.

(56) References Cited

U.S. PATENT DOCUMENTS 4,697,290 A * 10/1987 Alklind ..... A61G 7/001 5/632
4,807,313 A * 2/1989 Ryder ..... A47C 19/045 5/610
5,257,430 A * 11/1993 Yamaguchi ..... A47C 21/028 254/93 HP
5,313,679 A * 5/1994 Yamaguchi ..... A47C 19/045 254/93 HP
6,739,005 B2 5/2004 Davis
6,795,989 B2 9/2004 Fairchild
7,917,979 B2 4/2011 Amsler, Jr.
9,510,698 B1 12/2016 Krotova
9,545,164 B2 1/2017 Tulloch
9,596,946 B2 3/2017 Scarleski
2010/0064434 A1* 3/2010 Amsler, Jr. ..... A47C 19/045 5/488
2013/0232698 A1* 9/2013 Ward ..... A47C 21/00 5/659
2015/0342359 A1* 12/2015 Molina ..... A47C 21/028 5/659
2015/0374134 A1* 12/2015 Bethel ..... A47C 19/045 5/412
2017/0105543 A1* 4/2017 Scarleski ..... A47C 31/105

* cited by examiner

*Primary Examiner* — Eric J Kurilla

(57) ABSTRACT

A tool that includes the components to raise a bed mattress above its mating box spring. This provides the space around the perimeter of the mattress to easily tuck a fitted sheet, mattress cover and/or blanket. It eliminates the need for lifting an unusually heavy mattress while attempting to perform the task at hand.

1 Claim, 8 Drawing Sheets

KEY:
A = CONTROL UNIT
B = RISER ELEMENT (WEB)
C = REMOTE CONTROL (OPTIONAL)
D = CONNECTION TUBE

BLOCK DIAGRAM

6A. CONTROL UNIT

6B. CONNECTION TUBE

6C. REMOTE CONTROL

MATTRESS LIFTING TOOL

CROSS REFERENCE TO RELATED APPLICATIONS

This application for US Letters Patent claims the benefit of U.S. Provisional Patent Application, Ser. No. 62/601,313, filed Apr. 7, 2017, and entitled Mattress Riser System, which is incorporated herein in its entirety.

BACKGROUND OF INVENTION

Field of the Invention

The present invention relates to the field of household tools, and more particularly to a tool for temporarily lifting a mattress above a supporting box spring.

Description of Related Art

Applying a tightly fitted sheet requires stretching the sheet over the mattress and tucking it between the mattress and box spring. It becomes necessary to lift up the heavy mattress and get the sheet neatly applied. In the age of thicker and heavier mattresses this task becomes more difficult. As we age the strength required to complete this task is daunting.

As can be seen by reference to the following U.S. Pat. Nos. 9,596,946; 9,545,164; 9,510,698; 7,917,979; 6,795,989 and 6,739,005, the prior art is replete with myriad and diverse devices for manipulating a mattress.

While all of the aforementioned prior art constructions are adequate for the basic purpose and function for which they have been specifically designed, they are uniformly deficient with respect to their failure to provide a simple, efficient, and practical tool for quickly and conveniently lifting a mattress to change bedding.

As a consequence of the foregoing situation there has existed a longstanding need for a new and improved mattress lifting tool and the provision of such a construction is a stated objective of the present invention.

BRIEF SUMMARY OF THE INVENTION

Briefly stated, the present invention provides a tool for temporarily lifting a mattress above a supporting box spring so that a fitted sheet or other bedding can be easily changed. The tool includes a inflatable tube that is positioned around and interior of the peripheral edges of the box spring. A control unit that includes a pump is connected to the tube and operated by a remote control. The proper positioning of the tube is facilitated by the base sheet that is attached to the tube and is sized to extend across the box spring spaced in from the peripheral edge.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings wherein.

DETAILED DESCRIPTION OF THE INVENTION

Figure 1:
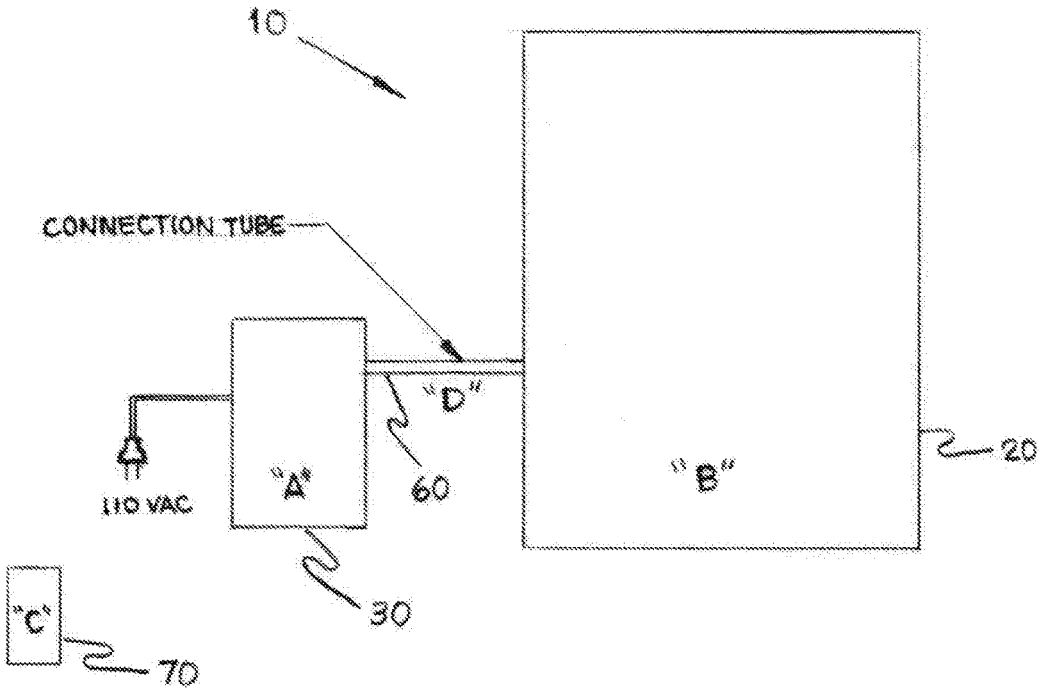
FIG. 1 is a top plan schematic view showing the components of the present invention.

As can be seen by the reference to the drawings, and particularly to FIG. 1, the mattress lifting tool that forms the basis of the present invention is designated generally by the reference number 10.

Figure 2:
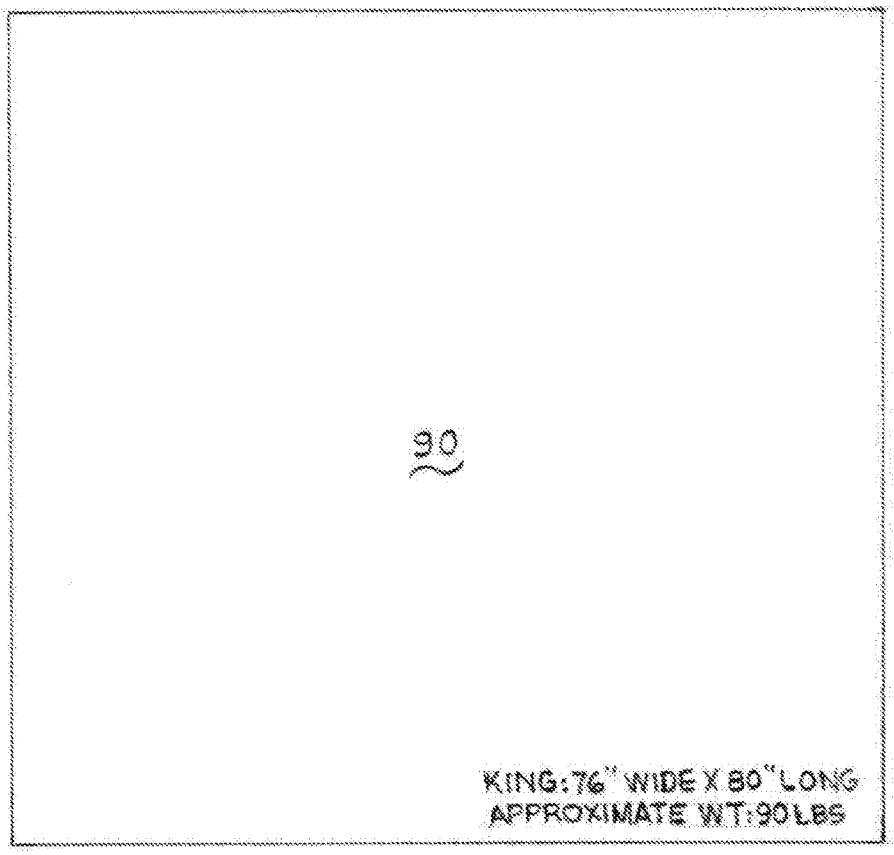
FIG. 2 is a top plan schematic view showing the size relationship between a king sized and queen sized mattress.
Figure 2:
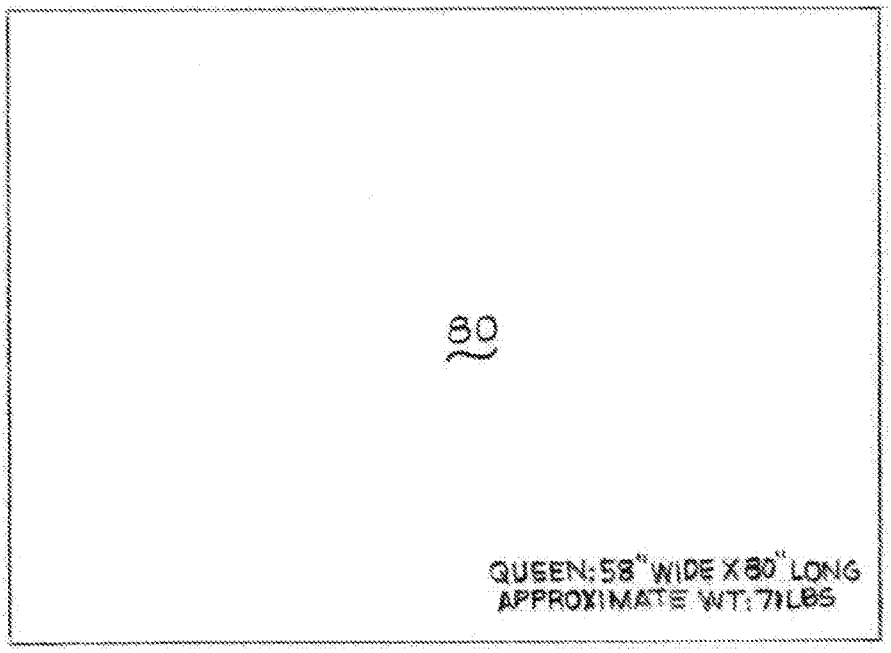

The mattress lifting tool 10 includes a web or inflatable tube 20, a control unit 30, a connection line 60, and a remote control 70 (FIG. 1). The lifting tool 10 may be used in conjunction with a mattress of any size, but is best suited for use with a queen sized mattress 80 or king sized mattress 90 (FIG. 2), since mattresses of these sizes are difficult to lift manually.

Figure 3:
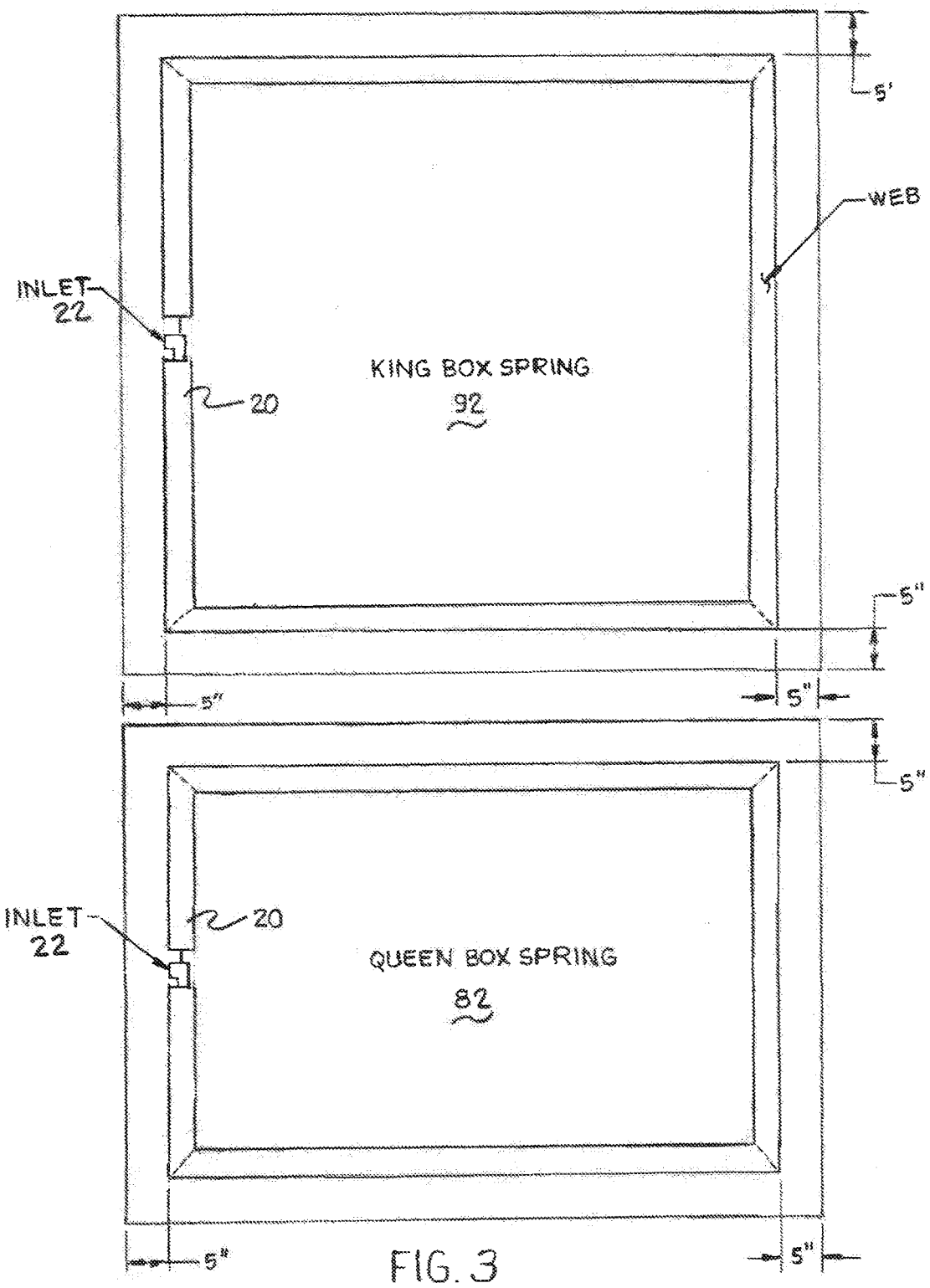
FIG. 3 is a top plan schematic view showing the positioning of the web or inflatable tube on the king sized and queen sized box spring.
Figure 4:
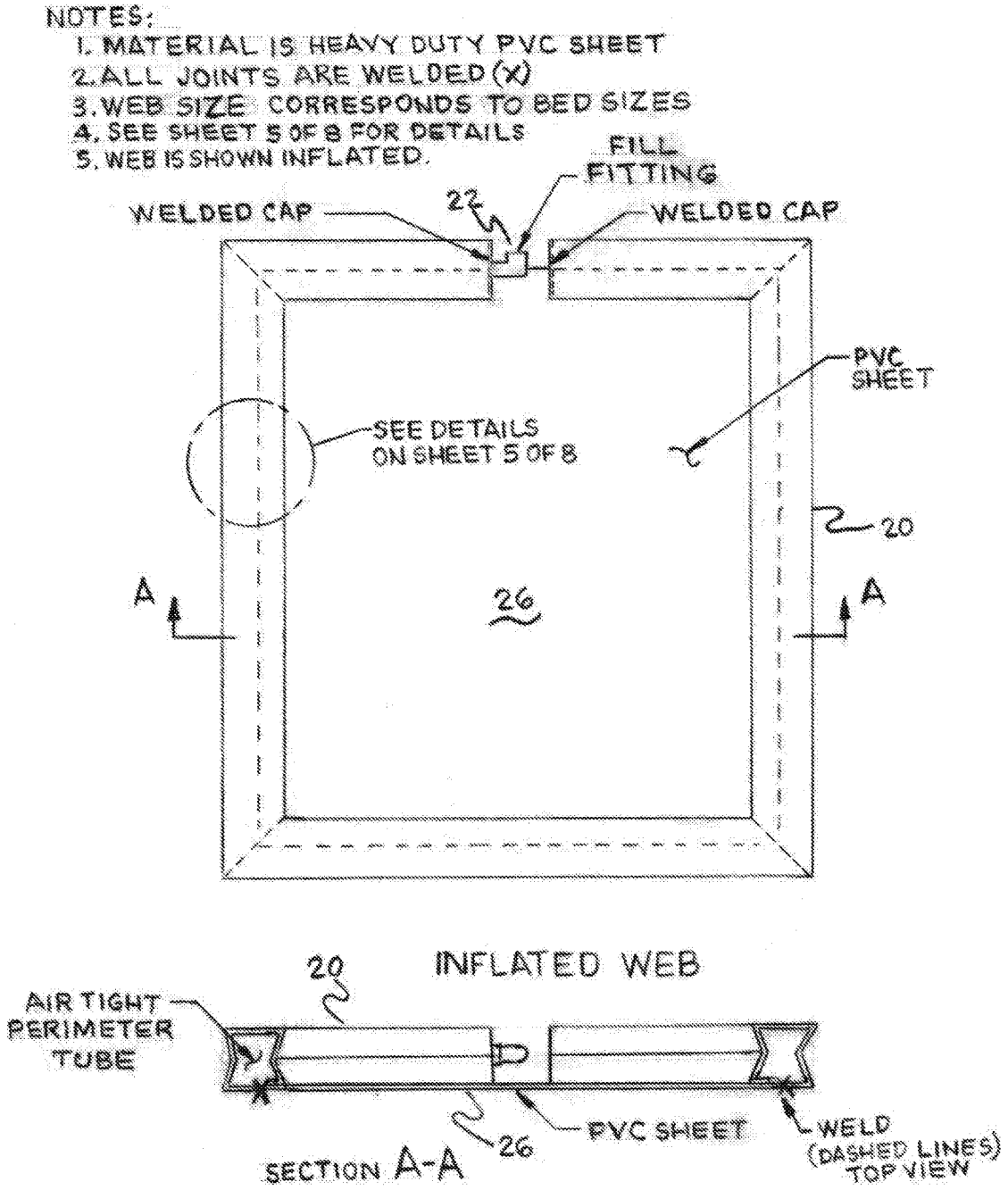
FIG. 4 is a top plan schematic view showing the base pvc sheet or panel attached to the web or tube, together with a partial perspective schematic view of a panel attached to the tube.
Figure 5:
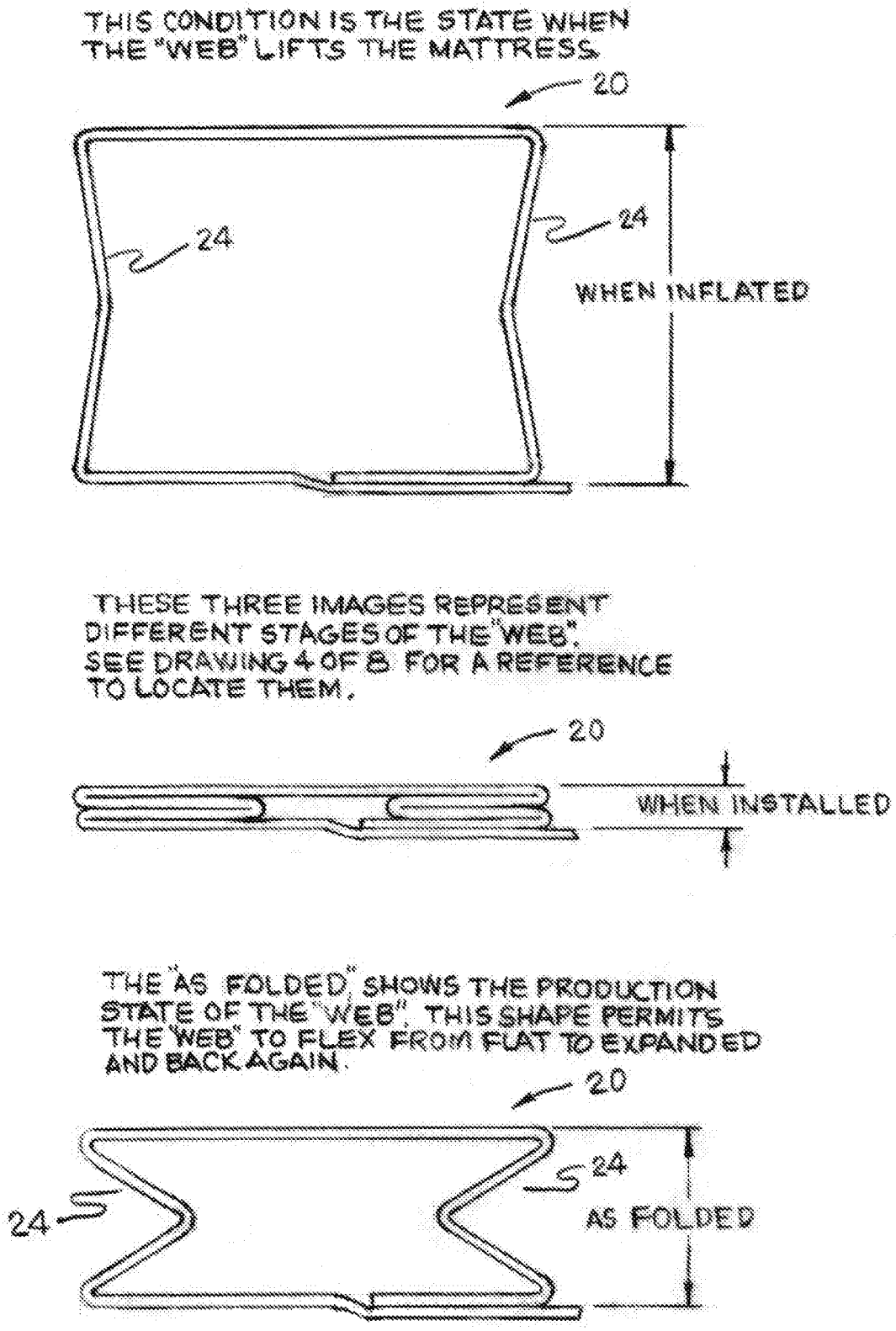
FIG. 5 is a side elevation sectional view showing the side gussets of the tube in the various stages of inflation.

As best shown in FIGS. 3-5, the inflatable tube 20 is sized to extend around and interior of the peripheral edge of a queen sized box spring 82 or king sized box spring 92, spaced in from the edge about five inches (FIG. 3). The tube 20 has a gas inlet 22, and gusseted sidewalls 24 that allow the tube 20 to lie flat when deflated (FIG. 5). A single planar base panel 26 is attached to a lower section of the tube 20, and is sized to extend in from the tube 20 across the box spring 82 or 92 interior of the peripheral edge to facilitate the proper positioning of the tube 20 with respect to the peripheral edge of the box spring 82 or 92 (FIG. 4). This provides a simple, compact, stable lifting element which is a great improvement over the complicated devices previously used.

Figure 6:
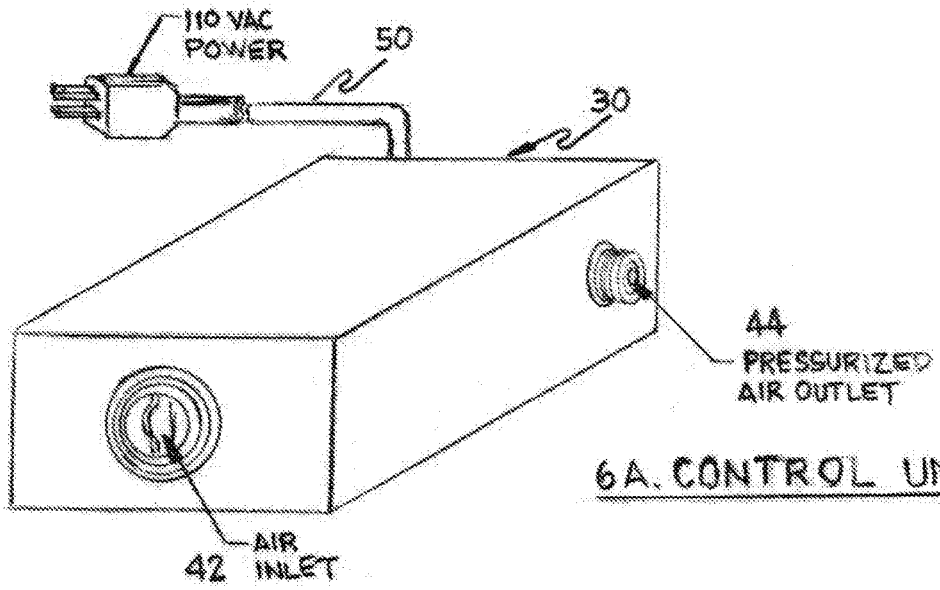
FIG. 6 is a perspective view of components of the present invention.
Figure 6:
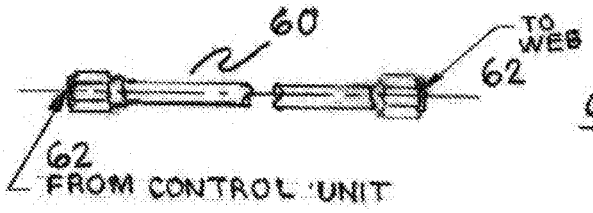
Figure 6:
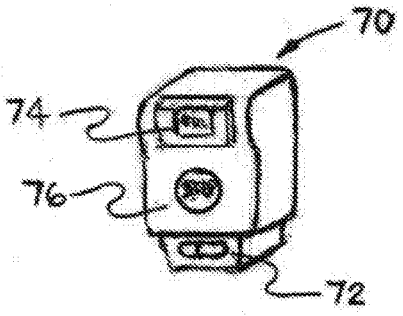

The control unit 30 (FIG. 6) includes a low pressure DC pump with an air inlet 42 and a pressurized air outlet 44. The unit 30 also includes a circuit board that controls the pump, the pressure regulator and an electrically operated value, and a transformer to convert AC or DC. An electric power cord 50 carries 100 volt AC voltage to the control unit 30. A connection line 60 includes end fittings 62 that connect the pressurized air outlet 44 to the tube inlet 22. The remote control 70 is a low voltage, battery powered, hand held unit with an attachment clip 72 to fasten to the operator. The remote 70 has a fill button 74 and an empty button 76.

Figure 7:
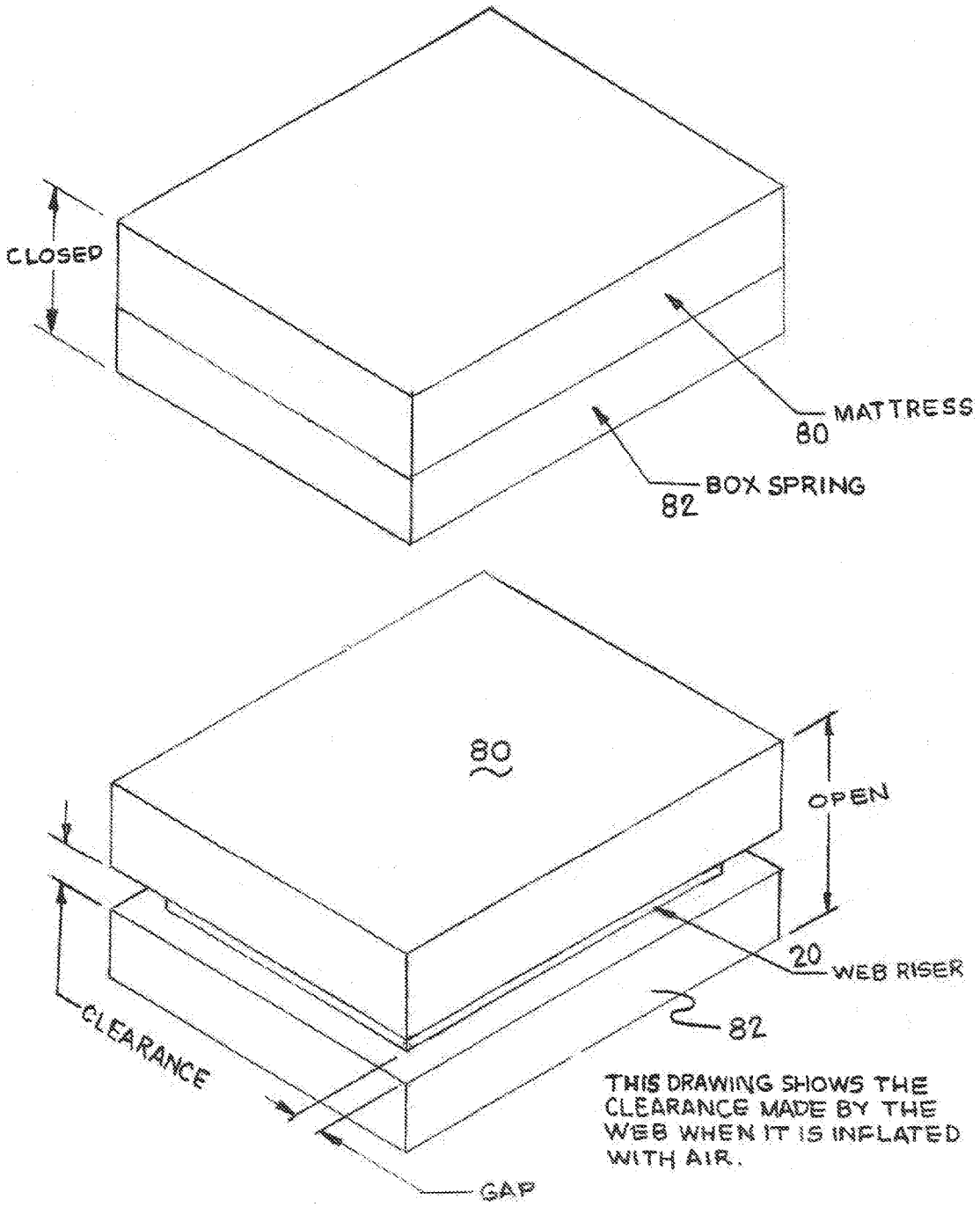
FIG. 7 is a perspective view showing the mattress and box spring in the normal position, and the mattress lifted above the box spring to allow space for attaching a fitted sheet to the mattress.
Figure 8:
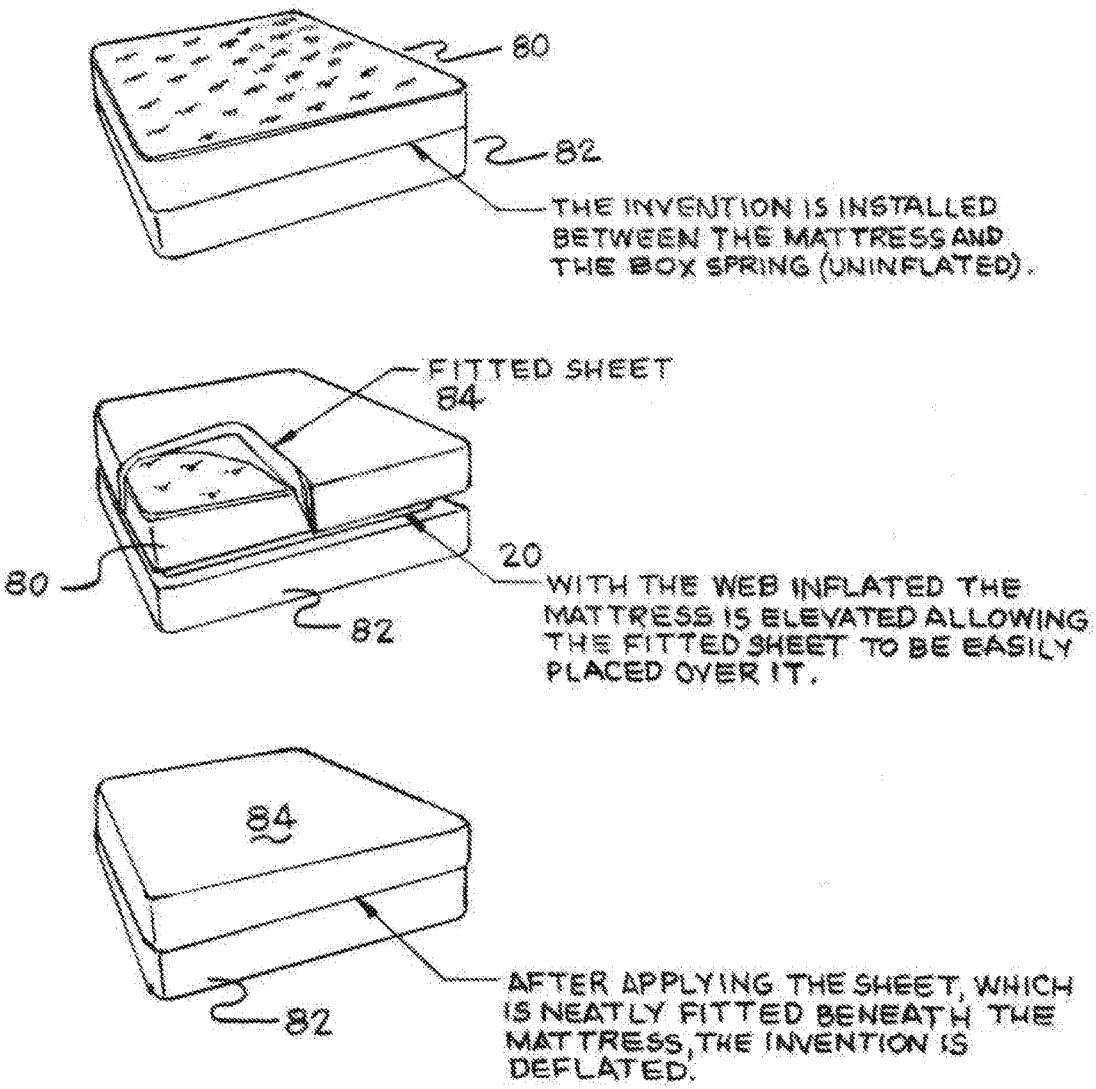
FIG. 8 is a perspective view illustrating the use of the mattress lifting tool to facilitate the operation of changing a fitted sheet.

As illustrated in FIGS. 7 and 8, the inflatable tube 20 of the mattress lifting tool 10 is positioned on the box spring 82 below the mattress 80, and is spaced in from the peripheral edge. When the tube 20 is inflated, the mattress 80 is lifted above the box spring 82 and provides open access to easily place a fitted sheet 84 over the lower edge of the mattress 80. The tube 20 is then deflated so that the mattress 80 is again on the box spring 82.

Although only an exemplary embodiment of the invention has been described in the detail above, those skilled in the art will readily appreciate that many modifications are possible without materially departing from the novel teachings and advantages of this invention. Accordingly, all such modifications are intended to be included within the scope of this invention as defined in the following claims.

The invention claimed is:

1. A tool for temporarily lifting a mattress above a supporting box spring, the tool consisting of:

a control unit;

a connection line;

a pump configured to be controlled by the control unit;

an inflatable tube having gusseted sidewalls connected to the pump via the connection line, the tube being disposed to extend around an interior of a peripheral edge of the box spring, the tube having a rectangular shape with a head end, a foot end, and two lateral ends that are each perpendicular to the head and foot ends;

the head end having two welded caps located near the mid-point of the head end with a tube inlet located between the two welded caps;

and a single planar base panel attached to a lower portion of the tube and being disposed to extend inwardly from the tube, interior of the peripheral edge.

* * * * *